US007775457B2

(12) United States Patent
Schnuckle

(10) Patent No.: US 7,775,457 B2
(45) Date of Patent: Aug. 17, 2010

(54) FOUNTAIN WITH FOG-FILLED, ILLUMINATED WATER DOMES

(75) Inventor: Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 253 days.

(21) Appl. No.: 12/098,518

(22) Filed: Apr. 7, 2008

(65) Prior Publication Data

US 2009/0250528 A1 Oct. 8, 2009

(51) Int. Cl.
*B05B 17/04* (2006.01)

(52) U.S. Cl. ..... 239/12; 239/18; 239/22; 239/102.2; 239/211; 239/289; 239/523; 239/524; 362/96

(58) Field of Classification Search ..... 239/2.1, 239/4, 11, 12, 14.1, 16–18, 22, 102.1, 102.2, 239/211, 289; 362/96, 253; 40/407
See application file for complete search history.

(56) References Cited

U.S. PATENT DOCUMENTS

| | | | | | |
|---|---|---|---|---|---|
| 3,690,554 | A | * | 9/1972 | Hruby, Jr. | 239/17 |
| 4,305,117 | A | | 12/1981 | Evans | |
| 4,975,811 | A | * | 12/1990 | Fraser et al. | 362/96 |
| 5,067,653 | A | * | 11/1991 | Araki et al. | 239/18 |
| 5,265,802 | A | * | 11/1993 | Hobbs et al. | 239/18 |
| 6,375,342 | B1 | | 4/2002 | Koren et al. | |
| 6,382,520 | B1 | | 5/2002 | Hones | |
| 6,854,661 | B2 | * | 2/2005 | Monitto | 239/102.2 |
| 6,935,760 | B2 | | 8/2005 | Bar-Cohen | |
| 6,971,586 | B2 | | 12/2005 | Fisher | |
| 6,971,779 | B2 | | 12/2005 | Tau et al. | |
| 7,187,141 | B2 | | 3/2007 | Mueller et al. | |
| 7,229,027 | B2 | | 6/2007 | Ehresman et al. | |
| 2001/0029206 | A1 | | 10/2001 | Henry | |
| 2006/0163375 | A1 | | 7/2006 | Skluzacek et al. | |
| 2006/0243819 | A1 | | 11/2006 | Beidokhti | |
| 2006/0255179 | A1 | | 11/2006 | Liao | |
| 2007/0084945 | A1 | | 4/2007 | Wei | |

* cited by examiner

*Primary Examiner*—Steven J Ganey
(74) *Attorney, Agent, or Firm*—Marsh Fischmann & Breyfogle LLP; Kent A. Lembke

(57) ABSTRACT

A fountain system for creating unique water displays or water attractions. The fountain system includes a pump providing water at a flow rate and a plurality of fountain assemblies connected to the pump outlet. Each of the fountain assemblies includes a nozzle such as a bell or dome nozzle that receives the water from the pump and discharges the water from its outlet in the form of an enclosed dome about the nozzle outlet. The fountain assembly includes a fog generator or fogger such as an ultrasonic transducer, positioned proximate to the nozzle discharging fog into the dome where it is trapped by the laminar flow water in the dome wall. Each fountain assembly includes a light source transmitting light into the dome to illuminate and color the captured fog. The flow rate may be changed to alter the shape and size of the domes.

24 Claims, 9 Drawing Sheets

FOUNTAIN WITH FOG-FILLED, ILLUMINATED WATER DOMES

BACKGROUND OF THE INVENTION

1. Field of the Invention

The present invention relates, in general, to water-based special effects and ornamental water fountains, and, more particularly, to a water fountain that combines the generation of fog or mist with illumination of captured portions of the fog to achieve desired effects.

2. Relevant Background

Water features or attractions continue to be popular for use in both small and large bodies of water. Homeowners often desire a water feature in their yards that may include a pond with running water and a fountain. Further, it is often desirable to include lighting and, in some cases, to create displays such as with fountains, lighting, and music that may be synchronized to operate in patterns. To be widely adopted by homeowners, the water feature and added special effects such as lighting and fountains generally need to be relatively easy to install and maintain as well as being inexpensive.

Much larger effects and water features are often provided in amusement parks and on hotel or resort properties. For example, many hotels now include large pools or ponds with fountains that are designed to entertain their guests and not just with waterfalls or other running water effects. One spectacular example is the Bellagio Hotel in Las Vegas, Nev., which provides a fountain attraction that includes an elaborate and massive musical fountain display with lights striking the fountains and sprays of water and with the fountains and lights being choreographed carefully to music. This extreme example costs millions of dollars to build and uses underwater pipes with over 1200 nozzles that often blast the water high in the air and also uses over 4500 lights to stage its fountain displays. Costs are not as important to creators of these larger effects and water features, but there is demand for new and interesting effects or illusions.

There are many other settings where ornamental water fountains and water special effects or attractions may be implemented. Water fountains may be used indoors and outdoors at theaters, shopping malls, city parks, museums, golf courses, and amusement parks. These fountains are often made aesthetically pleasing by configuring the water into particular patterns such as by design of the nozzles. Lighting may be used to create visually pleasing and entertaining programs, but lighting effects are only used or effective at night for illuminating water display patterns such as with lights of one or more colors. In these settings, the property owners generally require that the fountain system be relatively inexpensive to purchase and install and also have low maintenance requirements.

Despite the substantial effort by fountain designers, there remains a continuing demand for novel fountain designs. Preferably, such fountain designs will provide unique effects and/or ornamentation while addressing at least some of the issues involving cost and maintenance.

SUMMARY OF THE INVENTION

The present invention addresses the above problems by providing a fountain system for creating unique water displays or for use in creating a water attraction or show. The fountain system includes pumps providing water at a flow rate(s) and a plurality of fountain assemblies connected to the pump outlets. Each of the fountain assemblies includes a nozzle or fountain head (such as a bell or dome nozzle) that receives the water from the pump and discharges the water from its outlet in the form of an enclosed dome about the nozzle outlet. Significantly, the fountain assembly also includes a fog generator or fogger, such as an ultrasonic transducer or the like, that is positioned proximate to the nozzle and that generates a water-based fog that is discharged into and captured or contained by the dome. This results in a relatively clear, water dome being transformed into a relatively opaque or translucent object. The dome is defined in some cases by a substantially continuous wall of the discharged water in laminar flow, and this wall may extend in continuously about the periphery of the nozzle (or about the entire periphery) and function to contain the generated fog within the dome.

Each fountain assembly may also include a light source selectively transmitting light from one or more lights (e.g., colored or white light bulbs, LEDs, or the like) into the dome to illuminate the fog captured there. The flow rate of the water provided to the nozzles may be controlled (such as directly by controlling a variable flow rate pump, by operating a flow regulator, by operating a flow control valve, or the like) to vary the flow and, as a result, vary the size and/or shape of at least some of the domes. In some embodiments, the fountain system may also include a gas supply system that selectively discharges gas such as propane into at least some of the domes and further include an ignition device operating to ignite the gas contained within the domes to create a flaming gas or an explosion.

According to another aspect of the invention, a method is provided for creating a water attraction or display in a body of water such as in a pool, pond, or the like. The method includes providing a plurality of fountain assemblies in a pattern within the body of water. Each of the fountain assemblies includes a nozzle configured to form domes or bells with discharged water, e.g., a bell fountain head or the like that discharges water as a wall of water defining a dome with a hollow, inner chamber. The method continues with pumping water to the fountain heads or nozzles to form a plurality of the water domes. Then, fog is discharged into the inner chamber of at least some of these water domes to create a display. The fog discharging may involve providing foggers, such as ultrasonic transducers, in each of the fountain assemblies and then operating the foggers to generate fog from the body of water or by other techniques.

The method may include in some or all of the domes illuminating the captured fog such as with colored light (from LEDs or other lighting devices), which may be transmitted upward into the dome inner chambers such as from below the surface of the water in the body of water. The pumping of the water may include varying the flow rate of the water so as to vary the size and/or shape of at least some of the domes to achieve a desired effect, and in some cases, the walls of the domes are formed with water flowing in a substantially laminar state as this facilitates the walls being able to at least partially trap the fog within the inner chamber of the water dome.

DETAILED DESCRIPTION OF THE PREFERRED EMBODIMENTS

Figure 1:
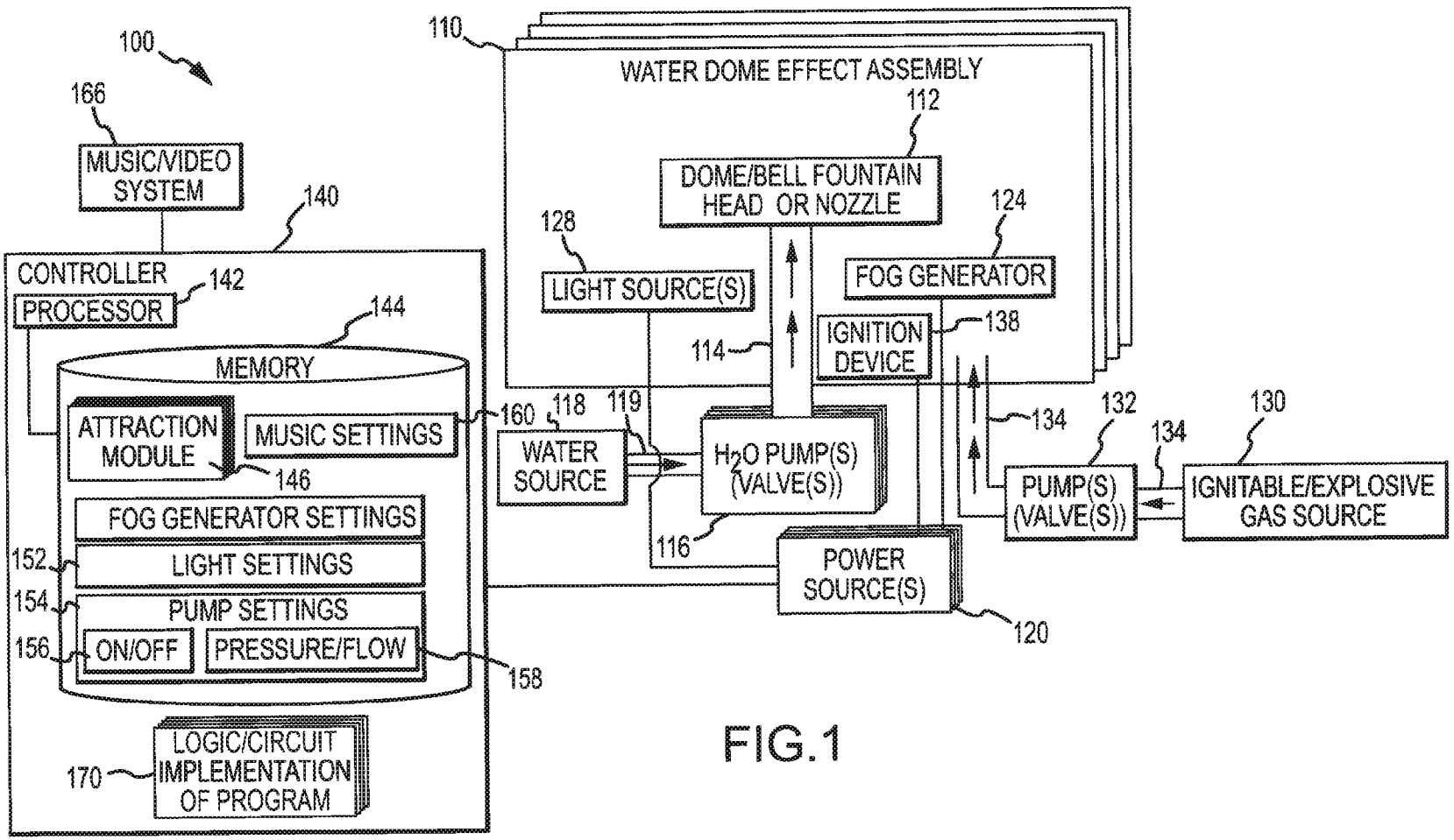
FIG. 1 is a functional block drawing or schematic of a water attraction system of an embodiment of the invention illustrating components useful to create water dome, bell, or chamber effects with the use of fog trapped or captured within walls of water.

Embodiments of the present invention are directed to providing unique special effects, imagery, and designs in a water attraction or feature. To this end, a fountain assembly is provided that includes a fountain nozzle or head that is configured to create a bell or dome-shaped shell of water on the surface of a pool, pond, or other water feature (e.g., at-home/in-home/backyard market as well as commercial applications). The water flows from the nozzle or fountainhead with laminar or similar flow to create a substantially continuous wall of water defining a hollow chamber (or interior volume or space of the water dome/bell). The fountain assembly also includes one or more devices that operate to inject or fill the hollow chamber with gas, e.g., a fogger may be used to fill the chamber with fog or water mist or a gas supply system may be used to provide an ignitable or explosive gas into the chamber. The gas by itself causes the water dome to change appearance as it becomes less translucent and even relatively opaque as it fills with fog or the like. In other cases, one or more light sources are provided to illuminate and/or color the gas contained or captured by the water dome wall(s). The fog or gas-filled domes contrast well against clear water found in many water features even in daytime or sunlight operations, and illumination and/or ignition provide attractive and unique effects such as for nighttime or low-lighting operations.

The fountain assemblies may be used alone as standalone devices or be combined or linked together in a water effect system or fountain system to form desired designs, patterns, and displays with two or more domes operated similarly or differently (such as via manual or programmed controls). As will be described below with reference to FIGS. 1-7, each fountain assembly or display can be configured to provide a desired shape and size such as by selecting a particular nozzle (e.g., small or large dome or bell fountain head) and/or providing water at a particular flow rate and/or pressure. Even for a particular nozzle, the size and shape of the dome or bell may be selected to achieve a desired effect and, in operation, the size/shape may be changed to create a particular effect (e.g., to increase and reduce the size/shape of the chamber in synchronization with changing music or to choreograph the various domes relative to each other). The domes may be created and destroyed/removed to achieve a desired effect or pattern (e.g., selectively create and remove domes across a feature to create patterns/shapes that change over time or with music or the like).

All or a portion of the domes may be filled with water-vapor fog (e.g., fog created by ultra sonic transducers, with LN2, with spray nozzles, or other foggers/fog generators). The fog filled domes can then be selectively lit or illuminated by any of a number of light sources (such as light emitting diodes (LEDs), video projectors, sources designed for use underwater, fiber optics, lasers, and the like). The domes may also be filled with flammable or explosive gas and ignited with a spark, pilot lighter, or other igniter (such effect may also be supported by providing additional oxygen). The fountain assemblies may be arranged such that adjacent ones of the created domes overlap in a manner that links their chambers to create a flow path for the fog and/or for the flammable/explosive gas to create unique designs and effects and to allow sharing of gas and fog sources. The domes may also be used to provide scent-based effects such as by injecting or diffusing scented substances into the dome or scenting a gas prior to pumping or injecting it into the chamber, and the scent is slowly released during operations or more fully by periodically removing the dome water wall or creating turbulent flow (e.g., flow that does not produce a substantially continuous water wall about the fountain head). In some embodiments, the fountain system includes numerous fountain assemblies, and these assemblies are operated to create a unique visual display with each assembly acting similar to a pixel in a television or computer monitor to create the design based on which assemblies are opaque or colored (e.g., RGB lighting used to simulate a television or computer monitor screen) at a particular moment in time. It is expected that with the concept of packaging or containing gas such as water-based fog or flammable gas within a water dome understood those skilled in the art will readily extend the ideas described herein to create numerous special effects and attractions using water features and the fountain assemblies described herein.

FIG. 1 illustrates with a functional block drawing a fountain or water effect system 100 of an embodiment of the invention such as may be used in a pond, a pool, a lake, or other water feature (which in some cases may even involve the fountain assemblies provided on a non-water base such as on a concrete or similar structure). A typical implementation would involve providing one, two, and, more typically, a plurality of water dome effect or fountain assemblies 110 in a structure holding water such as a pool, a manmade or natural pond or lake, or any other commercial or residential/home market body of water. In this embodiment, each fountain assembly 110 includes a dome or bell fountainhead or nozzle 112 (with fountainhead and nozzle being used interchangeably herein). The nozzle 112 that extends some height or distance about the surface of the water or be a telescoping or retractable nozzle that extends above the water surface based on water flow/pressure in inlet line 114. The nozzles 112 are typically configured to produce a dome or bell formed by water flowing out of the nozzles 112, e.g., laminar or relatively non-turbulent sheets or walls of water about the periphery of the spray head or diverter of the nozzle 112. The size and shape of the produced dome (not shown in FIG. 1) may be varied to practice the invention and will typically depend upon the configuration of the nozzle, the height the nozzle extends from the water surface, and the water flow rate (or water pressure) in the inlet line 114, with the invention not being limited to a particular shape or size of the dome (but in some cases including the feature of selectively adjusting the shape and/or size during operation to facilitate an effect). The fountain assemblies 110 may be spaced apart a distance such that the domes do not contact each other (e.g., spaced apart about twice the radius of the domes) or be arranged to interact or link (e.g., to create flow paths between adjacent domes for fog and/or gas).

The system 100 further includes a water source 118 for providing the inlet water to the nozzles 112, and, typically, one or more pumps 116 along with necessary plumbing (valves, water lines, tubes, pipes, and the like, and couplings) are provided to provide the water to the nozzles 112 at one or more desired flow rates (and/or pressures). The water source 118 may simply be the water feature itself with a supply or return line 119 being provided to link the pump inlet to a drain point in the water source/feature 118 or the source 118 may be a separate supply (such as when the nozzle 112 is located apart from a water feature or used without such a feature/water store). A single pump 116 may be used to drive two or more of the fountain assemblies 110 such as with an inlet manifold used to direct or divert inlet water to each nozzle inlet 114 or, in other cases, a pump 116 is provided for each assembly 110.

The pump 116 is powered by a dedicated or shared power source 120, and operation of the pump 116 may be controlled simply with an on/off operation of the power source 120 and/or with signals from a controller 140 (e.g., to control the power source 120 supply of power to pump 116 and/or directly control operation of the pump. Further, the operation of the pump 116 may be selectively controlled to be on/off or to vary the flow rate (and/or pressure) to selectively achieve desired dome/bell shapes with a nozzle 112 (e.g., some pumps may allow varying flow rates or may be controlled by reducing the flow rate in inlet line 119 (e.g., with a flow control valve, a diverter valve, or the like). The flow rate provided by pump 116 may vary to practice the invention and is typically selected to suit a particular nozzle or fountain head 112 design, with some embodiments using pumps 116 that provide a flow rate in the range of up to about 180 gallons per hour (GPH) or more such as up to about 700 to 1200 GPH or more as an upper pump capacity range. The pump 116 typically will also be a pump designed for pumping liquids such as water and, at least in some cases, for installation under water (e.g., a submersible pump designed to be corrosion resistant and, in some cases, to be water cooled or otherwise cooled/lubricated without oil) although this is not required. For example, the pump may be a magnetic drive pump, a positive displacement pump, a rotary pump, or other pump such as pump designed for use in many landscaping, pond, fountain, and other similar applications.

Significantly, the system 100 further includes a fog or water vapor/mist generator 124 (sometimes referred to simply as a fogger) that is positioned proximate to the nozzle 112 such that at least a portion and more typically all or most of its generated fog is captured within the water wall of the created dome or bell. For example, the fog generator 124 may be positioned adjacent the nozzle (or its feed line 114) and, typically, some distance or depth under the surface of the water. As it operates, the fog it generates rises upward into the void or hollow chamber within the water wall of the dome or bell. As discussed above, the water wall produced by the nozzle 112 prevents or substantially slows the fog from exiting the chamber (e.g., blocks flow until the gas pressure rises enough to cause a small volume to escape through the wall or wear the wall contacts the water surface or at the outlet of the nozzle). In this manner, the transparent to translucent water dome fills with fog and becomes relatively opaque (e.g., white with fog or water vapor). A variety of fog generator or water vapor generator devices may be used to practice the invention such as, but not limited to, generators using LN2 or spray nozzles using the water or another source. In some cases, the generator 124 includes one or more ultra sonic transducers configured for use as a fogger when placed a particular depth under the surface of water (e.g., under the surface of the water source 118 or the like). The fog generator 124, if necessary may be powered by power source 120 (e.g., an electrical power source), and the generator 124 may be selectively operated by the controller 140 directly or as shown by operation of the power source 120.

The use of the fogger 124 alone with the nozzle 112 provides a desirable effect including making the dome appear opaque or colored white, which is very useful in day time/sunlight conditions and also in nighttime applications where the water feature is illuminated with lights external to the domes. To provide a color-based effect or an effective nighttime effect, the fountain assembly 110 may include one or more light sources 128. The light sources 128 may be positioned in system 100 to be outside the dome formed by the nozzle 112, but, more typically, the light source 128 is positioned near the nozzle 112 or inlet line/conduit 114 and directed generally upward. In this way, the light source 128 illuminates all or at least portions (which may be selected to achieve a pattern) of the trapped or captured fog within the chamber or dome interior void space. The light source 128 may be underwater lighting or be lighting provided above the surface of the water feature such as LEDs, incandescent lighting, lasers, video or other image projection devices, and the like. In one case, the light source 128 includes underwater lighting that is white and placed under water or at or above the water surface. In another embodiment, the light source 128 includes two or more bulbs or sources that are differing colors (such as a red, a blue, a green, and other colored LEDs or the like). As with the fog generator 124, the power source 120 (or another independent source (not shown) may be used) is used to power the light source(s) 120 and the controller 140 is used to provide on/off control of the power source 120 and/or the light source 128. In some cases, the controller 140 also controls the color of the light source 128 (or the light source 128 may include firmware/hardware or logic to change color as is the case with some LED and other light source devices). The combination of the light source 128 and the light (white or other colors) with the generated and captured fog from fogger 124 creates a unique water dome effect, and this effect is significantly enhanced by the presence of the fog as it acts as an at least partially opaque screen that can be illuminated by the light (or projected images) from source 128.

In some embodiments, the system 100 further includes a source 130 of a gas that is flammable and/or explosive such as propane or the like. The gas from the source 130 is allowed by pumps/valves 132 to flow in piping to the fountain assembly 110. More particularly, the gas is directed to flow into the chamber or interior space of the dome or bell created by a wall of water by the nozzle 112. The outlet of the piping 134 may be provided near the nozzle 112 (or within a diameter of a created dome/bell) above, at, or below the surface of the water in the attraction containing the assembly 110. An ignition device 138 is used to ignite or trigger/explode the gas within the dome or bell of the assembly 110. As necessary or useful, the device 138 may be powered by the power source 120 and controlled to activate or light in response to control signals by the controller 140 directly to the ignition device 138 or to the power source 120 to operate the device 138. The controller 140 also typically functions to control flow of the gas from source 130 such as by selectively operating the pump and, or valve 132 in line 134. The fountain assemblies 110 may be isolated such that one or more of the domes contains gas from source 130, or the assemblies 110 may be located proximate to each other such that at least two or more of the domes created by the assemblies 110 are interconnected to provide a flow path for the gas from source 130 (e.g., such that only one source 130 is provided for all or a subset of fountain assemblies 110 or to share the source 130). Then, when the gas is ignited by operation of the ignition device 138 the gas in the flow path and associated domes or assemblies 110 will be ignited or exploded.

Further, as shown, the system 100 includes a controller 140 that functions to selectively operate the components of the system 100 including some or all of the pump 116, the fog generator 124, the light source 128, the gas source/supply 130, and the ignition device 138. The controller 140 may be configured to provide an operator with a manual control over the power source 120 so as to provide an on/off switch for the assembly 110 and/or pump 132 and ignition device 138. Alternatively, as shown, the controller 140 may provide functionality that allows the system 100 to be used as a programmable attraction to perform repeatable shows and/or otherwise create an entertaining display that may include synchronizing operation of assembly 110 with a music and/or video system 166. The controller 140 may include a processor or CPU 142 that runs one or more attraction modules or programs 146 in memory 144. Based on these routines or programs 146, the controller 140 may operate the assemblies 110 to create an attraction such as by selectively operating one or more of the pumps 116 to create water domes with nozzles 112. The dome creation may be achieved with or based on pump settings 154 that include on/off settings 156 indicating when to operate particular pumps (or to direct water flow to particular nozzles 112) and/or flow (or pressure) settings 158 defining a flow setting for one or more of the nozzles 112 to set the size and/or shape of the created dome or bell (e.g., with more flow generally creating a larger diameter or flatter dome and less flow resulting in a smaller diameter dome with more vertical side or even sides with small gaps for allowing some gas or fog to selectively escape). The pump settings 154 may, of course, differ among the various attraction modules or show programs 146 to achieve desired visual effects.

The controller 140 may also use fog generator settings in memory 144 for the attraction module 146 being run to determine when to operate the fog generator 124 and for which of the fountain assemblies 110. For example, the fog generators 124 may have their operation tied to the operation of the pump 116 such that fog is generated whenever a dome is created, but, in many cases, the foggers 124 are selectively operated such that some of the domes of assemblies 110 may have fog while others do not to create a desired effect. In other cases, the controller 140 may run a module 146 and operate the music/video system based on music settings 160. Then, choreographed or independent of the music settings, operate the pumps 116 based on the pump settings 154 to create a set of water domes with nozzles 112. Then, at the same or a later time, operate the foggers 124 of all or a subset of the assemblies 110 associated with these nozzles 112 to fill the domes or bells with fog or water mist. In many applications, such as nighttime or low light level settings, the controller 140 may then use the light settings 152 to determine when and how to operate the light sources 128. Again, the lights 128 may all be fully illuminated or the lights 128 may be selectively and variable operated to create an effect such as in time or with synchronization to the music settings 160 for a particular show or attraction module 146. The lights 128 may be monochrome with all being white or being differing colors for differing assemblies 110. In other cases, some or all of the light sources 128 may include two or more colored lights and the controller 140 may choose which color (or blend of colors) to use based on the light settings 152. Although not shown, settings or routines may also be provided for use in the controller 140 operating the pumps 132 to pump or provide gas into the domes and for triggering the ignition device 138. In some embodiments, logic/circuitry 170 is provided to cause the controller 140 to control the system 100 in a particular manner (e.g., to provide a hardware/firmware solution for controlling the assemblies 110 such as may be useful in a residential or commercial setting in which the "show" is a more simple, repeated routine).

Figure 2:
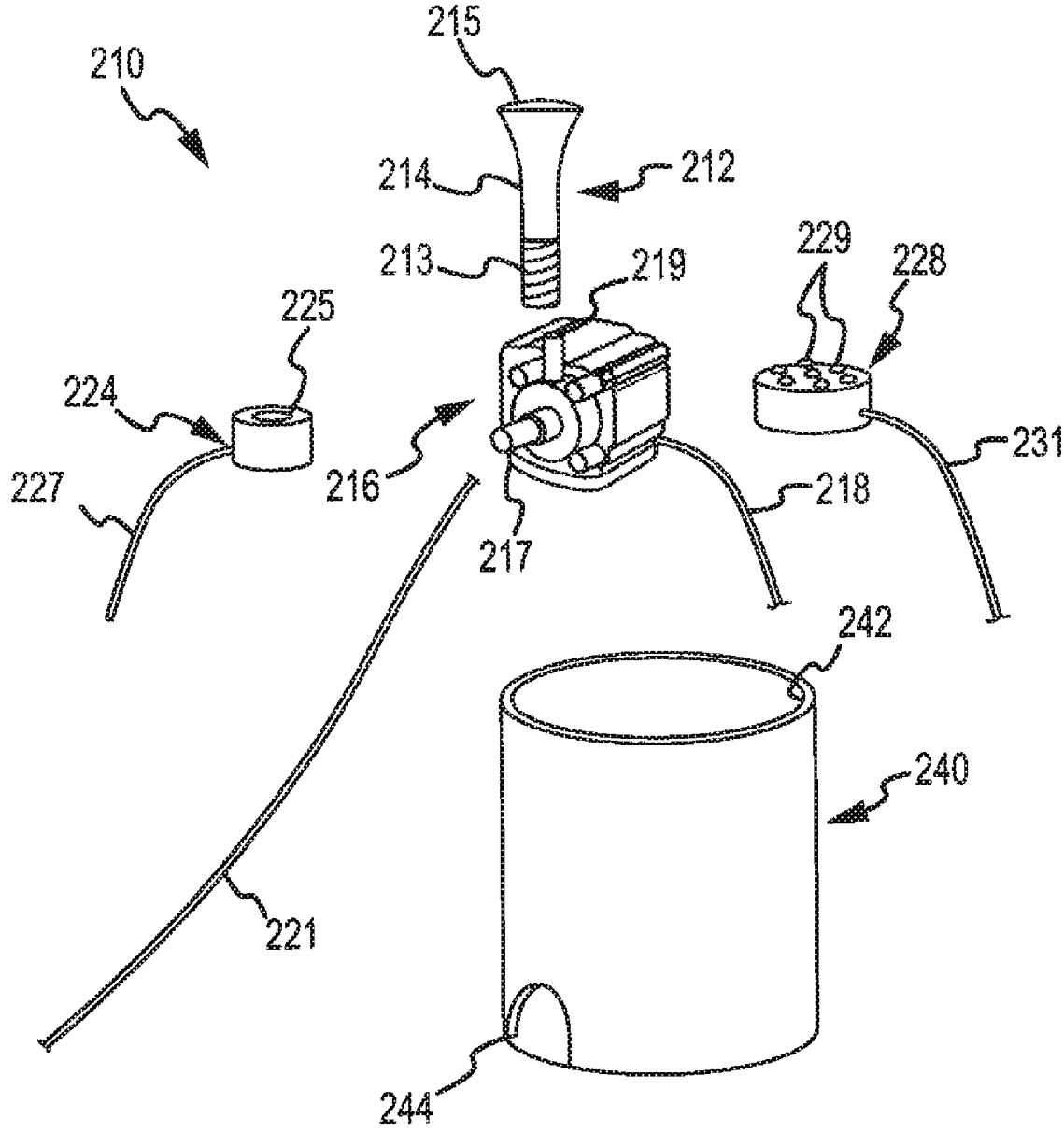
FIG. 2 illustrates components of a fountain or water dome effect assembly (or, more simply, fountain assembly) prior to assembly and installation at a site such as within a manmade or natural water feature.

FIG. 2 illustrates components of one embodiment of a fountain assembly 210 of the invention, such as may be used in the system 100 of FIG. 1. As shown, the assembly 210 includes a nozzle or fountain head 212 that is configured with an extension or inlet tube (or nozzle body) 214 having a threaded end 213 for connection with an outlet 219 of a pump 216. The nozzle 212 includes a spray head or diverter 215, shown in the closed or retracted position, that acts to direct water flow out of the nozzle body 214 into a laminar sheet that, typically, is exits the nozzle body 214 in a 360 degree manner and transverse to the longitudinal axis of the nozzle body 214 (e.g., generally perpendicular to this axis and then downward due to gravity). In other words, the nozzle 212 is a dome or bell fountain head. Such nozzles are readily available from many sources such as landscaping supply companies and particularly those specializing in ponds, pools, and other water features and the nozzles 212 may be labeled as large bell nozzles or large bell fountain heads, aqua dome fountain head or nozzle, small bell fountain head or nozzle, or the like that produce bell, mushroom, dome, or similar shapes with pumps ranging from about 80 GPH to 700 GPH up to 1200 GPH or more. The height of the dome is generally that of the nozzle 212 with the diverter telescoped outward or a bit higher (such as up to 8 to 24 inches or more), and the diameter of the dome may vary widely to practice the invention such as from several inches up to 2.5 to 4 feet or more with 1 to 2 feet diameters being common. The design or configuration of the nozzle 212 and the pump 216 flow rate are preferably paired so as to produce a dome formed by walls that are substantially continuous such as with a laminar or relatively non-turbulent flow. In this manner, the formed wall of water of the dome or bell can act to trap or contain fog, scented vapor, and/or other gases such as flammable or explosive gas within the chamber defined by the wall and the surface of the water (or other structure if used outside of a body of water such as on a concrete fountain floor or the like).

The pump 216 further includes an inlet or return 217 that connects with a water supply or return line 221, which, in turn, is connected to a water source for the assembly 210. The pump 216 also includes a power cord 218 that is electrically connected to a power supply (not shown), and the illustrated pump 216 is a single speed pump that operates in response to receiving power. The pump 216 and nozzle 212 are positioned within a shell or housing 240 via opening 242 and with the water supply line 221 entering via inlet or opening 244. The shell or housing 240 may be configured to hide or disguise the assembly 210 when it is installed in a water feature and/or to protect it from damage.

Additionally, the fountain assembly 210 includes a fogger 224 that, in this case, includes an ultrasonic transducer 225 that is electrically powered via cord 227 and a power supply (not shown). The fogger 224 may be a specially designed or configured device or, in some cases, it may be an off-the-shelf device such as devices readily available from many fountain and water feature supply companies (e.g., devices marketed as ultrasonic mist makers, fountain foggers, or the like). In other embodiments, the assembly 210 may include a differing fog generator such as one that uses a spray nozzle to create a water or other liquid mist or a fog generator using liquid nitrogen (LN2). Prototypes, however, have proven to the inventor that conventional ultrasonic foggers work very well in rapidly producing enough fog to fill or alter the appearance of a water dome or bell (such as filling a water dome with a 2 to 3 foot diameter and a 8 to 12 inch height in about 30 seconds to about 3 to 5 minutes or more while initial filling is visible nearly immediately).

The fountain assembly 210 further includes a light source 228 powered and/or controlled via cable or cord 231. The illustrated light source 228 includes a plurality of lights or bulbs 229 so as to be able to illuminate created and trapped fog with differing colors. For example, the light source 228 may include 2, 3, 4, or more LEDs as individual lights 229, and, in some embodiments, the light source 228 is operable to illuminate or power 1, 2, or more of the LEDs 229 to generate a quantity of light that has a particular color. Further, in some cases, the LED 229 that is used at any particular point in time is preferably selectable by a controller (as is shown in system 100 of FIG. 1) or by logic provided at the source 228 or manually with a switch (at the source 228 or controller (not shown)). The fogger 224 and the light source 228 may be positioned within the housing 240 so as to be proximate to the nozzle 212, and at least the fogger 224 typically is positioned under the surface of a body of water or water feature.

Figure 3:
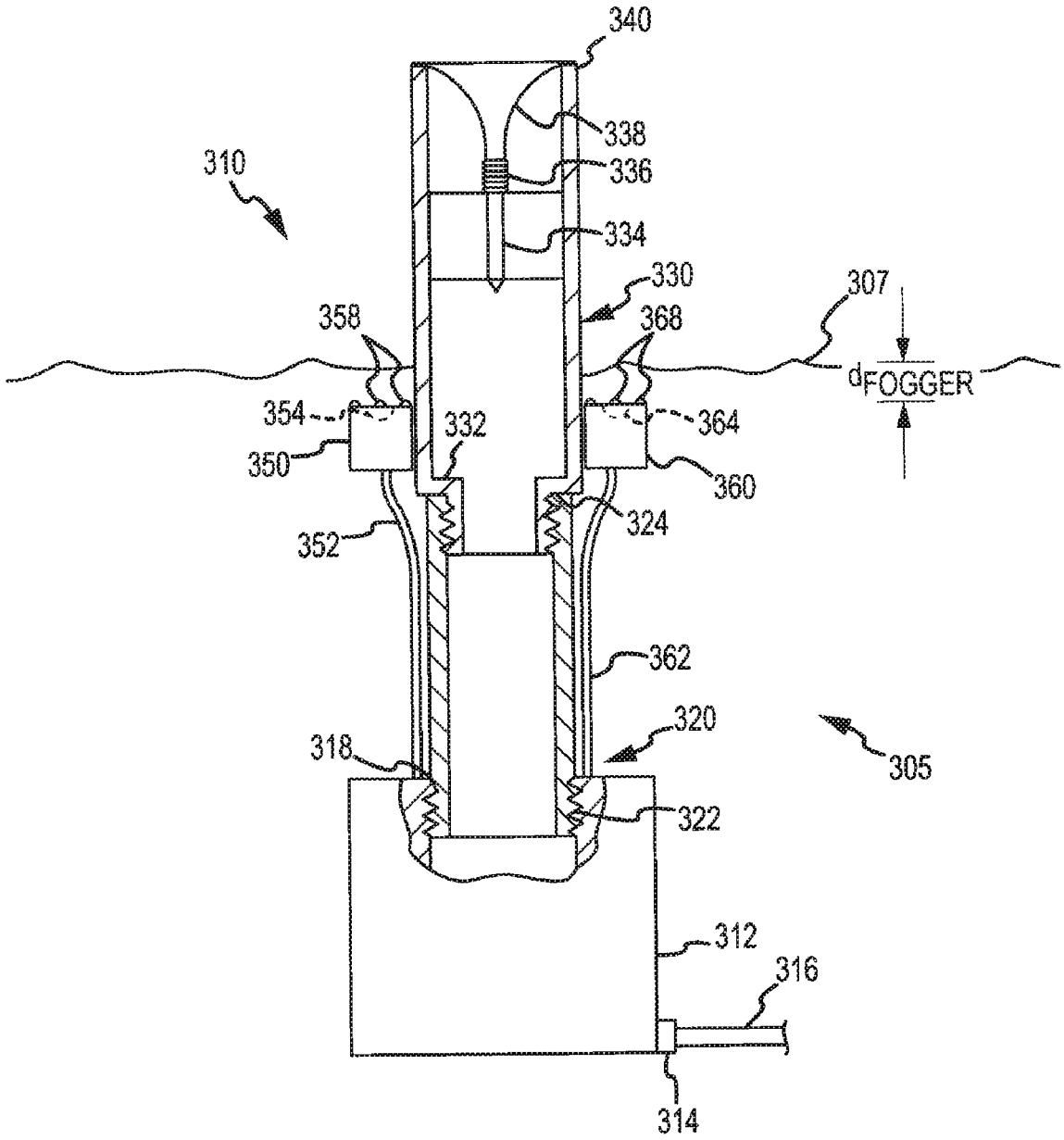
FIG. 3 is a partial sectional view of a fountain assembly for use alone or with a plurality of other similar or differing fountain assemblies in a water attraction system of the present invention, e.g., in the system of FIG. 1 or other fountain system.
Figure 4:
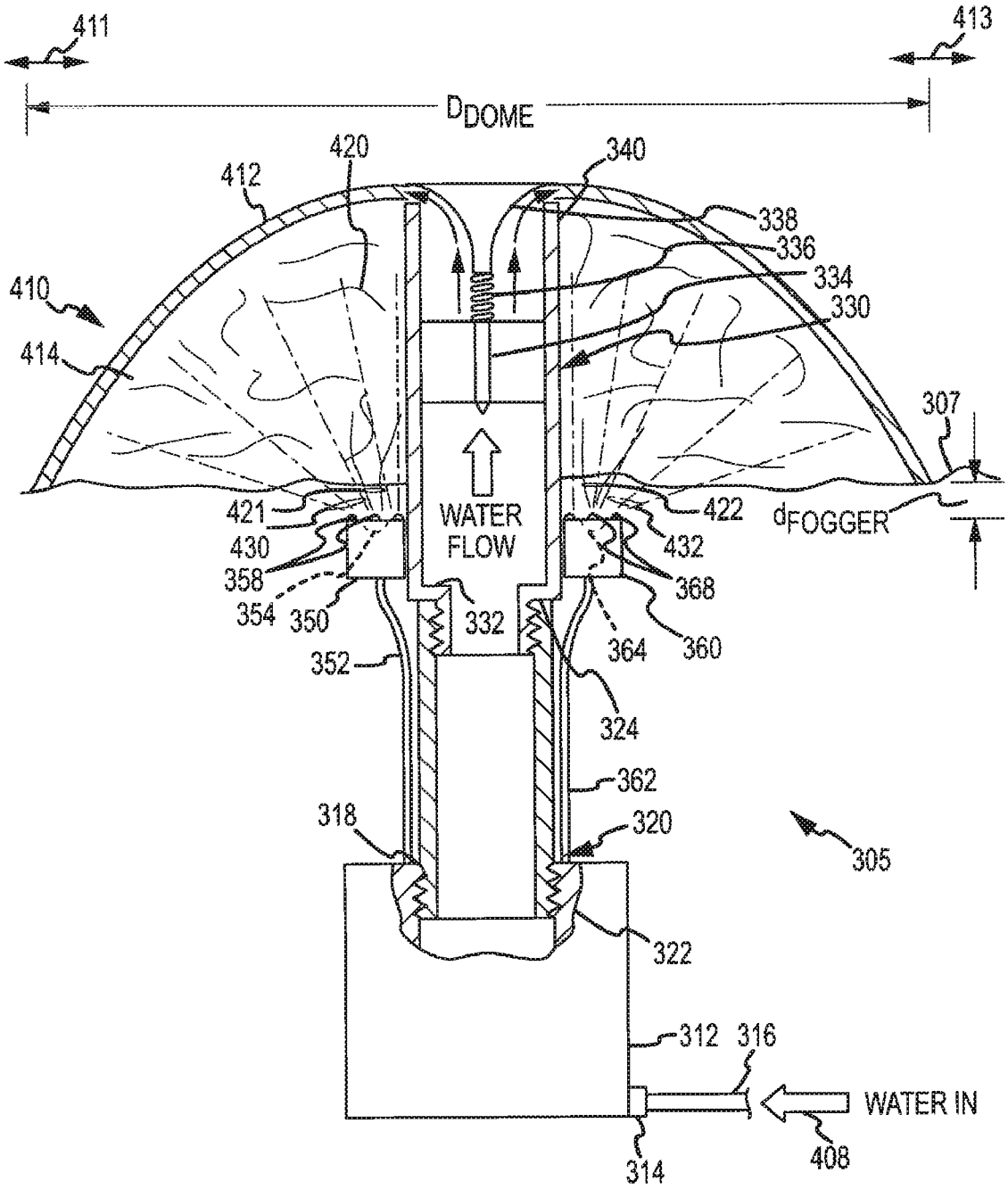
FIG. 4 illustrates the fountain assembly of FIG. 3 in use or operation (e.g., in response to power and/or control signals from a controller as shown in FIG. 1 or a simple on/off switch as may be used in residential and more basic commercial implementations) to create a water dome with illuminated fog or water mist.

FIGS. 3 and 4 illustrate an embodiment of a fountain assembly 310 for use in providing illuminated, fog dome effects. FIG. 3 illustrates the assembly 310 prior to use or in an off or rest position while FIG. 4 illustrates the assembly 310 in full use (e.g., with a water dome formed, the dome's chamber filled with fog, and the fog illuminated whereas partial or staged use may be the dome formed or may be the dome formed and filled or partially filled with fog but not yet illuminated).

As shown, the fountain assembly 310 includes a pump 312 positioned in a water feature or body of water 305 below the surface 307. At a pump inlet 314, a water supply line 316 is connected to provide inlet or supply water to the pump 312. A nozzle extension or riser 320 (e.g., a rigid tube, pipe, or the like) is threaded or otherwise coupled at a first end 322 to the outlet 318 of the pump 312. At the other end 324, the nozzle riser (or nozzle inlet line) 320 is connected to an inlet end 332 of a nozzle or fountain head 330. The body of the nozzle 330 is generally a hollow cylinder that directs water flow from the pump 312 upward to an opening at an outlet end 340. In the assembly 310, the nozzle 330 is fixed in position with a portion extending above the surface 307 of the water 305 with its outlet 340 at a particular height, such as up to about 8 to 12 inches or more. The height of nozzle outlet 340 above the surface 307 is selected to correspond (at least generally) with a height of the bell or dome to be formed with the nozzle 330.

A diverter or spray head component 338 is shown in a closed or retracted position abutting against or resting upon the outlet 340. The diverter 338 has a distal end 334 attached to the body of the nozzle 330, and this rigidly attached end 334 is connected to the diverter 338 with a spring, coil, or other elastic member 336 that acts to retract the diverter 338 when there is no or little water flow as shown in FIG. 3 but to allow the diverter to telescope to an open or spray position as shown in FIG. 4 under a certain level of water flow/pressure. The diverter 338 is generally shaped to direct water outward generally transverse to the longitudinal axis of the nozzle body 330 such as substantially perpendicular (or somewhat above or below a plane perpendicular to the nozzle axis). Also, the diverter 338 is configured in some embodiments to direct water flow in a substantially equal amount or volume about the periphery of the nozzle outlet 340 to form a continuous wall of water to form a dome or bell (but in some embodiments, a partial dome is formed with overlapping, adjacent domes mating so as to provide an enclosed chamber for fog and/or flow path for flammable/explosive gas).

In addition to the nozzle 330, the assembly 310 includes a pair of foggers or fog generation devices 350, 360. The foggers 350, 360 are shown to be positioned proximate to the body of the nozzle 330, and in this case, to be attached to or mounted to the outer wall of the nozzle 330. In this embodiment of assembly 310, the foggers 350, 360 each include an ultrasonic transducer 354, 364 that is operable in response to power provided on cords or lines 352, 362 to generate a water mist or fog. To this end, the foggers 350, 360 are preferably positioned a depth, $d_{fogger}$, below the surface 307 of the body of water 305. Also, in the assembly 310, the foggers 350, 360 are shown to include LEDs or other bulbs 358, 368 (e.g., a light source), which are also powered via power lines 352, 362. In this case, the LEDs 358, 368 are positioned at about the depth, $d_{fogger}$, of the fogger 350, 360 and directed upward (e.g., parallel to the longitudinal axis of the nozzle 330). As discussed previously, the LEDs may all be a single color such as white, red, green, or blue or, more typically, will be a set of differing colors that are selectively operable to illuminate fog generated by fogger transducers 354, 364 with one or more colors to suit a particular attraction/show or effect. In the assembly 310, two foggers 350, 360 are shown, but it will be understood that a single fogger may be utilized in some assemblies 310 and others may utilize 3 or more. Also, the foggers 350 and 360 are shown to be configured similarly in assembly 310 but in some cases they may be configured differently such as with differing lights or with differing fog generation devices to achieve a desired effect (e.g., one may be an ultrasonic transducer while the other may include a spray nozzle, a LN2 supply, or the like).

FIG. 4 illustrates the assembly 310 during its use to provide a fog-filled, illuminated water dome effect. As shown, the pump 312 is being nm or operated to draw in water at 408 from a water source (not shown) and to force or pump the water through the extension 362 and nozzle 330. The water 408 is discharged from the nozzle between the outlet 340 and the diverter 338 (e.g., is directed outward by spray head or diverter 338). As shown, the discharged water forms a bell or dome 410 with a wall of water 412 that extends from the nozzle outlet 340 to the water surface 307. The water wall 412 has a thickness that may vary (such as from about 0.1 to about 0.5 inches or more) but preferably with few or no gaps as may be achieved when the flow rate of the water 408 is matched to the nozzle 330 to achieve relative laminar or non-turbulent flow (e.g. the wall 412 is made of substantially continuous flow of water or of volume of water in laminar flow). Also, in some embodiments, the wall 412 extends about 360 degrees about the nozzle 330 (e.g., at a substantially constant radius from the central axis of the body of the nozzle 330).

The dome wall 412 (or its inner surface) defines an inner void space or hollow chamber 414. The size of the dome 410 and its inner chamber 414 are defined by a height (e.g., the height or amount the nozzle 330 extends above the water surface 307) and by a diameter, $D_{DOME}$, that varies with the height, the nozzle/diverter design, and the flow rate of water 408. As shown with arrows 411, 413, the diameter, $D_{DOME}$, of the dome 410 may be intentionally varied or set during operation of assembly 310 such as by changing the flow rate of water 408 (e.g., by modifying operation of pump 312, by operating a valve(s) in the line 316 to control flow, or the like). In practice, the diameter, $D_{DOME}$, may be varied from about the outer diameter of the nozzle body (or its outlet 340) to about 1 to 3 feet with some assemblies 310 providing larger domes that are up to 4 feet or more in diameter (e.g., with a relatively large nozzle outlet height above surface 307). The particular diameter chosen is often not as interesting visually as the functionality of the assembly 310 that allows this diameter to be set and then varied 411, 413 to achieve differing appearances for the dome 410 without changing the nozzle 330 or its diverter 338.

As shown, the foggers 350, 360 are both operated in FIG. 4 with the ultrasonic transducers 354, 364 acting to create fog or water mist 421, 422 that rises up into the inner chamber 414 of the dome 410 to provide a volume of fog or water mist 420. The fog 420 is captured or contained by the water wall 412, and the dome 410 changes in appearance from a transparent or clear dome of water into an opaque shape (e.g., a fog-filled mushroom, bell, or dome-shaped element). In FIG. 4, the fog 420 is also illuminated as shown at 421, 422 by operation of the light sources (e.g., LEDs) 358, 368 in one or both foggers 350, 360, and the light sources 358, 368 may be chosen to be the same color or to be two or more colors (e.g., the fog 420 may be lit or colored with a blend of colors to achieve a desired effect). The light/rays 421, 422 may be relatively constant or may pulse together or independently.

Figure 5:
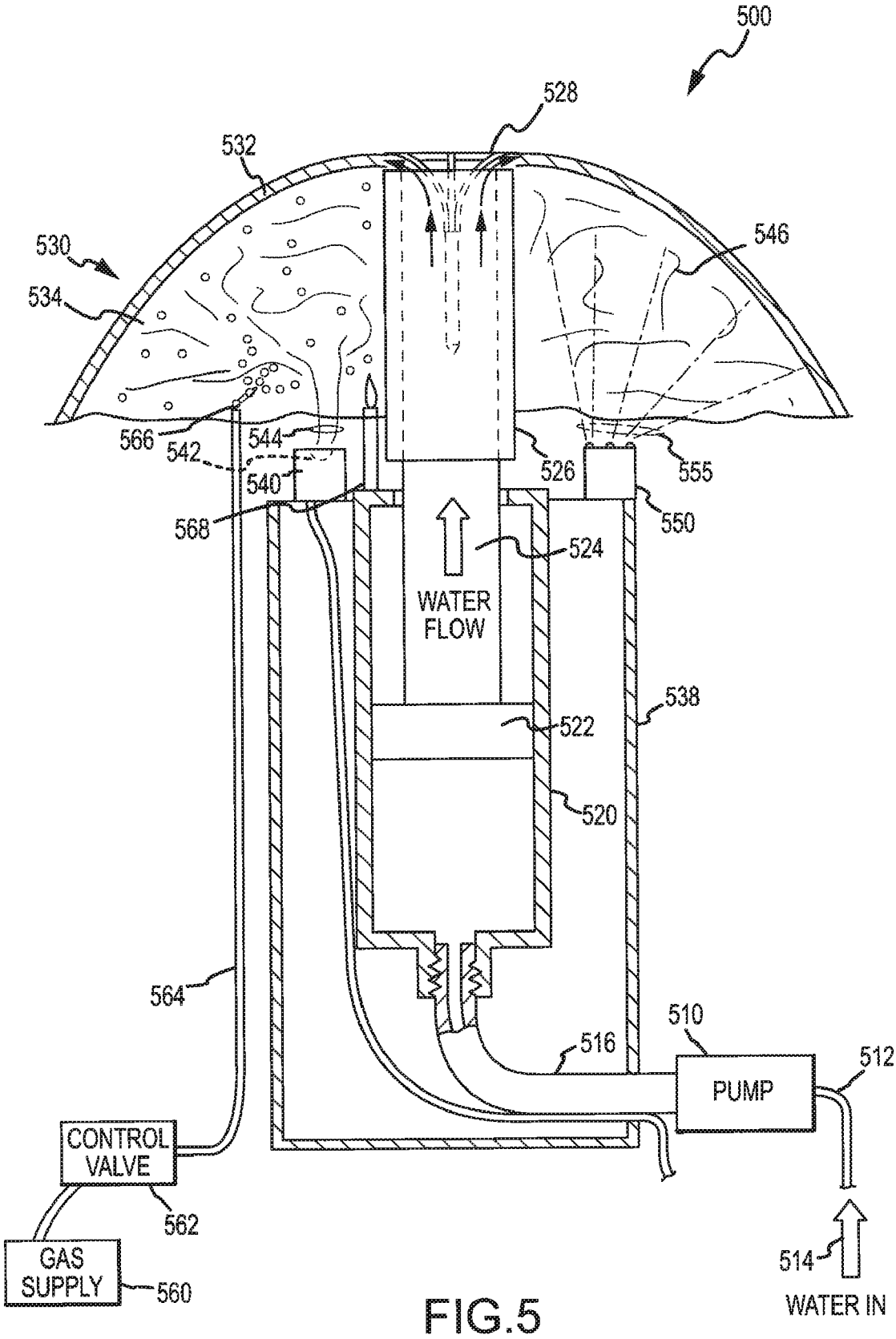
FIG. 5 illustrates a sectional view of another embodiment of a fountain assembly illustrating use of extendable or rising fountain nozzle along with ignitable/explosive gas to create a water dome special effect.

FIG. 5 illustrates another embodiment of a fountain assembly 500 that is operating to create a dome or bell 530 with a wall 532 of flowing water. This creates an inner chamber or contained volume 534 for containing or trapping a volume of fog or water mist 546 (e.g., fog and water mist and similar terms are used interchangeably herein). In this embodiment 500, a pump 510 is connected via supply line or tube 512 to a water source to draw in or pump a volume of water 5114 at a flow rate (which may be relatively constant or selectable over a range to achieve a number of shapes/effects). The pump 510 in this case is positioned external to a housing or support structure 538 that is positioned under the surface of the water, but in other cases the pump 510 may be provided within the housing 538 and even act as a support for a nozzle assembly. Another line or tube 516 is provided to connect the pump outlet to an inlet of a piston or retraction body 520.

The assembly 500 makes use of a telescoping or retractable nozzle 526, and the nozzle 526 retracts into the body 520 when there is no water flow or not enough to cause it to extend or telescope outward. As shown, the water flow 514 from the pump 510 is adequate to push on a piston 522 to move a piston or extension rod 524 upward and, as a result, move the nozzle 526 out of the body 520. This telescoping causes the nozzle 526 (or at least its outlet) to extend a height above the water surface. The flowing water 514 also causes the diverter or spray head 528 to extend out or become separated from the nozzle outlet to allow the water of the wall 532 to flow outward from the nozzle 526 and form the dome 530. When the pump 510 is turned off or flow is reduced below some level, this process is reversed with the diverter 528 retracting toward the nozzle 526 and the nozzle being retracted into the body 520. The use of the assembly 500 may be desirable for "hiding" the nozzle 526 until it is desired for an effect or as part of an attraction to create a fog-filled water dome 530. The assembly 500 may be used in a system such as system 100 shown in FIG. 1 with other similarly designed assemblies or in conjunction with different assemblies such as the assembly 310 of FIGS. 3 and 4.

The assembly 500 also differs from the assembly 310 as it includes a fogger 540 with an ultrasonic transducer 542 for generating at 544 fog or water mist but that is separate from a light source 550. Both are mounted to or near the top of the housing 538 and positioned adjacent and proximate to the nozzle body 520. The light source 550 may be similar to the one used in assembly 310 with one or more LEDs or, as shown, be a single bulb light (such as a white or colored light bulb or the like) used to transmit light 555 to illuminate the captured fog 546 within the chamber 534.

The fountain assembly 500 also includes components for achieving an ignited or exploded gas effect. To this end, the assembly 500 includes a gas supply 560 that may be located distal to the assembly 500 positioned in a water feature. The gas provided by supply 560 may be a flammable or ignitable gas such as propane or the like or be a more explosive gas that tends to explode when triggered, ignited, or sparked. A control valve 562 is provided to control flow of the gas (such as in response to a control signal from a controller as shown in FIG. 1 or a manual operation by an operator) into supply line 564. The supply line 564 shown to be provided on or near the housing 538 and to have an outlet at or near the surface of the water (or it could be lower such as near the top of housing 538). The location for the line outlet is chosen such that the flammable or explosive gas from supply 560 is delivered into the chamber 534 as shown at 566, where it is trapped similarly to the fog 546 by the water wall 532. Further, to ignite the gas 566, the assembly 500 includes an ignition (or explosion trigger) device 568, which may provide a spark, flame, or the like to ignite the gas 566 or to trigger an explosion within the dome 530. The ignition device 568 is remotely operable so as to allow an operator to ignite the gas 566 or to allow a controller, such as an attraction or other controller to selectively operate (such as part of a show program) the ignition device 568 such as after the control valve 562 has been opened for a preset period of time to provide an adequate or desired amount of gas 566 within the chamber 534 proximate to device 568.

Figure 6:
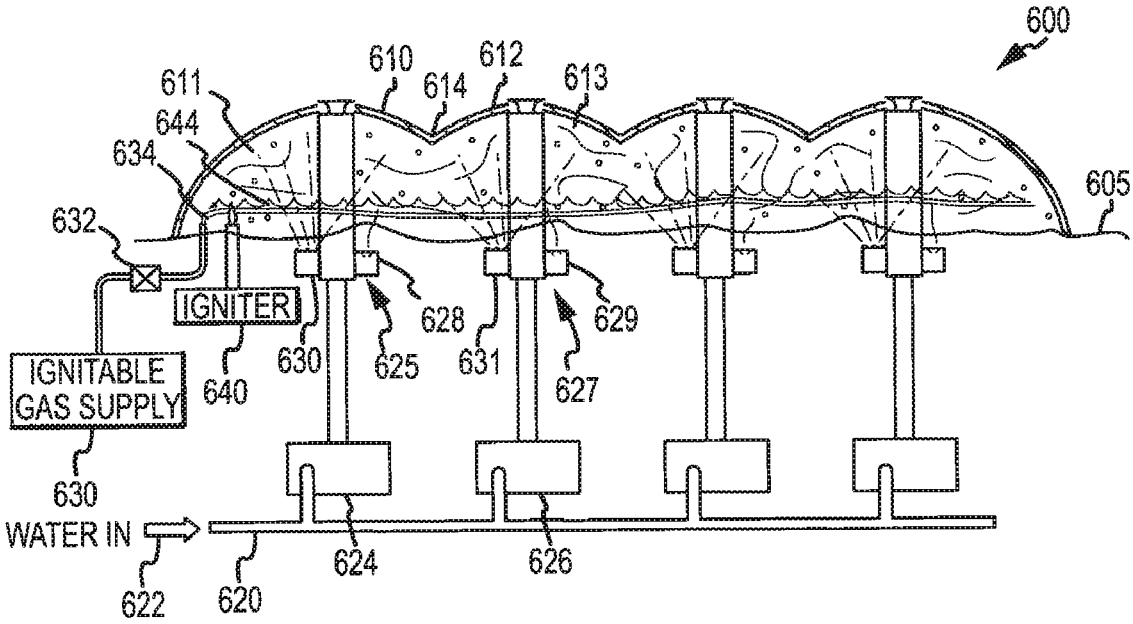
FIG. 6 illustrates a portion of a water attraction system of the invention including two or more fountain assemblies arranged to provide a flow path or connected chamber for ignitable/explosive gas (or, in some cases, mist or fog if foggers are shared) among the domes or bells formed by the adjacent fountain assemblies.

As discussed above, the fountain assemblies of the present invention may be used and operated as standalone devices, but, in many cases, a fountain display system is created (as shown in FIG. 1) to create a desired effect by using a plurality of fountain assemblies that are positioned to provide a visually appealing imagery and are operated in some synchronized or even choreographed manner. FIG. 6 illustrates one example of a fountain display system 600 in which a plurality of fountain assemblies (which may take any of the forms described herein) are combined to provide a desired effect. Specifically, the effect includes creating a shared or overlapping chamber or flow path for fog and for flammable or explosive gas (or for scented vapor or the like).

As shown, a plurality of water domes 610, 612 are created by fountain assemblies including bell or dome nozzles 625, 627 driven by inlet pumps 624, 626. The nozzles 625, 627 are positioned such that the domes 610, 612 contact each other as shown at seam or joining surface 614, and, in this manner, the inner chambers 611, 613 of each dome 610, 612 are connected (e.g., in fluid/gas communication). Additionally, the diverters of the nozzles 625, 627 may be configured to facilitate such overlapping to create a combined outer wall and inner chamber. Each fountain assembly may also include a fogger 628, 629 to generate fog that is placed below water surface 605 of the water feature, but in some cases only one or less than all of the fountain assemblies will include a fogger so as to allow the fog to travel between chambers 611, 612 in the open or shared gas flow path. The assemblies also include light sources 630, 631 such as a set of LEDs or the like that may be provided separately as shown or as part of the foggers 628, 629. The pumps 624, 626 are provided supply or inlet water 622 via a manifold 620 that includes branches and, in some cases, valves controlling flow to each pump 624, 626.

To create a flame or explosion effect, the system 600 includes a gas supply 630 that provides propane or other gases via a control valve 632 (or other flow regulator) into the chamber 611. The injected gas stream 634 flows not just in chamber 611 of the first dome 610 but along a flow path joining the adjacent domes into the chamber 613 of dome 612 and so on to other connected or linked domes of system 600. The gas 634 may be heavier than the surrounding air such that it remains near the surface 605 or the fog 611 may, in some instances, act to guide or control flow of the gas 634 along the surface 605. The system 600 further includes an igniter 640 that when triggered manually or by a controller issuing a control signal while running a show or effect routine causes the gas stream 634 to ignite as shown with flames 644 (or to explode depending on the gas in stream 634 and other operating parameters). For safety reasons, the valve 632 may be closed prior to operating the igniter 640, and, in some embodiments, one or more of the domes 610, 612 may be reshaped after ignition of stream 634 such as to douse a fire with the water wall of dome 610, 612 or to isolate one or more pools/islands of flaming gas 644 or to achieve another effect. In other words, the domes 610, 612 may be varied in size and shape to create the flow path or shared chamber and then later to return the domes 610, 612 to a more isolated state (e.g., by reducing the diameter of the dome such that there is not an overlap or intersection of nearby walls).

Figure 7:
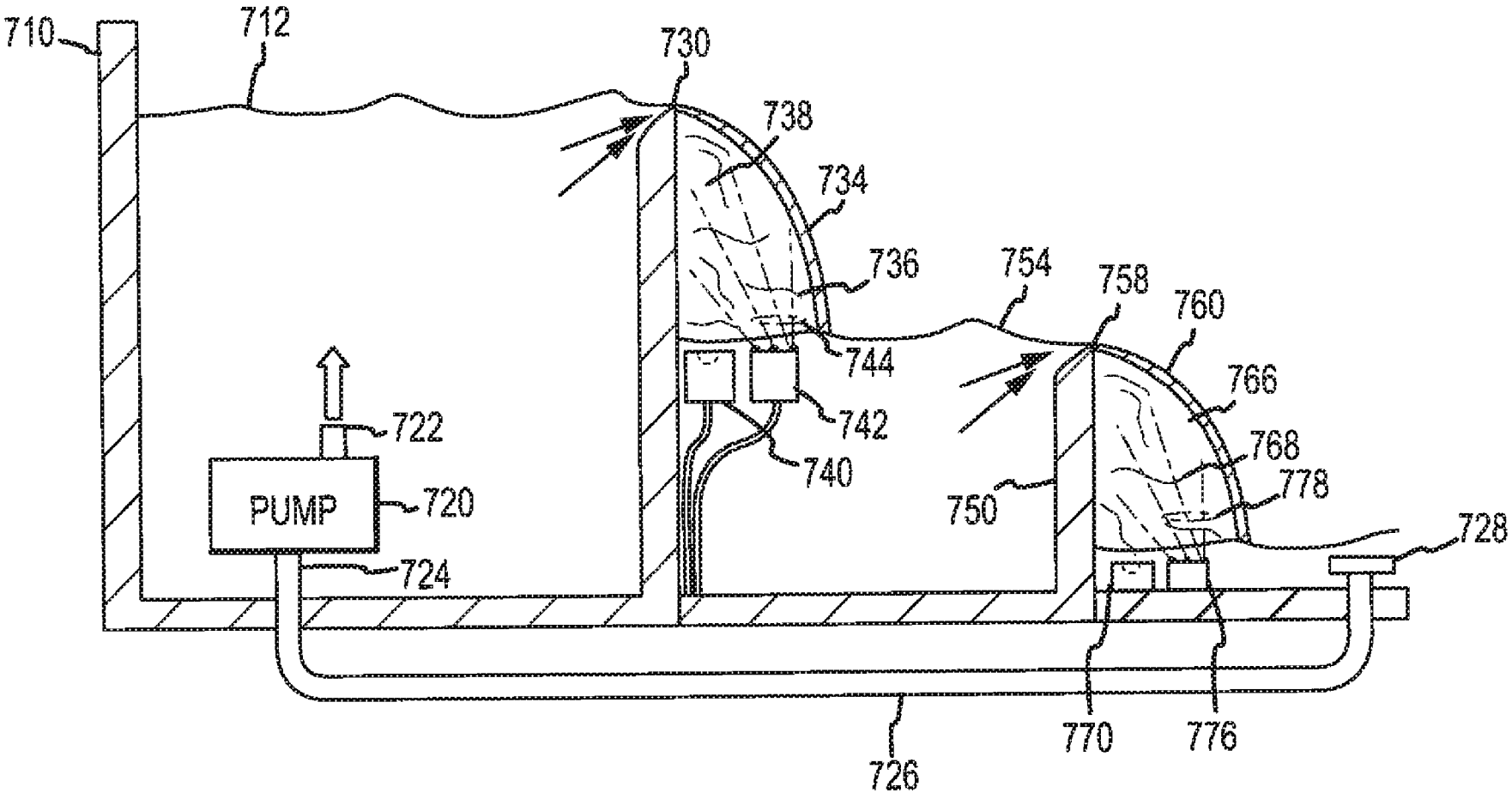
FIG. 7 illustrates a water attraction system that makes use of the water captured or contained water fog/mist and/or ignitable gas in a water fall feature.

The concepts described herein for capturing fog or other gases with a wall of water are not limited to use with bell or dome nozzles. For example, FIG. 7 illustrates a water effect system 700 in which volumes or pockets of fog are captured behind walls of water or waterfalls and then illuminated (or ignited if the fog includes a flammable gas or the like). In the system 700, a waterfall base or pool structure 710 is provided to hold water in supply and receiving pools or basins as shown with water surfaces 712 and 754. In the upper basin of the structure 710 a pump 720 is provided that discharges supply or return water via outlet 722 and draws water in via inlet 724 that is connected by line 726 to a drain 728 (and/or make up water may be provided with line 726 such as to account for evaporation).

The tops of adjoining walls 730, 758 are configured to cause or encourage the flow of water from the surfaces 712, 754 to be relatively laminar such as with a waterfall weir arrangement or the like. In this manner, the wall of water 734, 760 falling from tips 730, 758 (or over walls 750) is substantially solid or continuous flow so as to provide few or any spaces for gas to escape. The edges 730, 758 may also be curved (such as U-shaped or C-shaped) such that the wall 734 and wall 760 are enclosed to have sides that contact or are proximate to structure 710 to better trap generated fog or released gas. As with the fountain assemblies, the system 700 also includes foggers 740, 770 to generate fog or water mist 738, 768 that is trapped in the chamber or void space 736, 766 created by the water walls 734, 760. Further, light sources 742, 776 are provided to selectively illuminate and, in some cases, color the fog 738, 768 with light 744, 778. The water then enters drain 728 and is returned via line 726 to pump 720 to form additional walls 734, 760 of water.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the above description stressed the illuminated, fog-filled dome ideas for use with water domes and/or water features for commercial or residential use. Of course, the liquid used does not have to be water and can be nearly any liquid, with many features working with nearly any translucent to transparent/clear liquid. The fogger may use the body of water it is provided within to generate the fog or it may provide fog from other sources (e.g., pump fog from other areas), and, in such embodiments, the fogger may be positioned above or with a fog discharge or outlet above the water surface.

Additionally, the foggers, as is common with existing ultrasonic foggers, may be provided with a float ring or other device(s) to allow the fogger (and included light sources in some cases) to maintain a desired location or depth relative to the water surface. In these preferred embodiments, the fogger is not rigidly fixed to other fountain structures but is allowed to move at least with the water surface (e.g., lateral movement may be restrained by providing a tether to other fountain components, by providing a tube or other structure that limits lateral movement of the floating fogger while allowing it to rise and fall with water levels, or the like). The float element or float ring may extend entirely or partially about the fogger, for example, and keep the ultrasonic element a preset distance below the water surface, which is desirable to account for varying depths/volumes of water in pool, pond, or other water containing structure (e.g., water level may vary several inches in a day for some applications).

Figure 8:
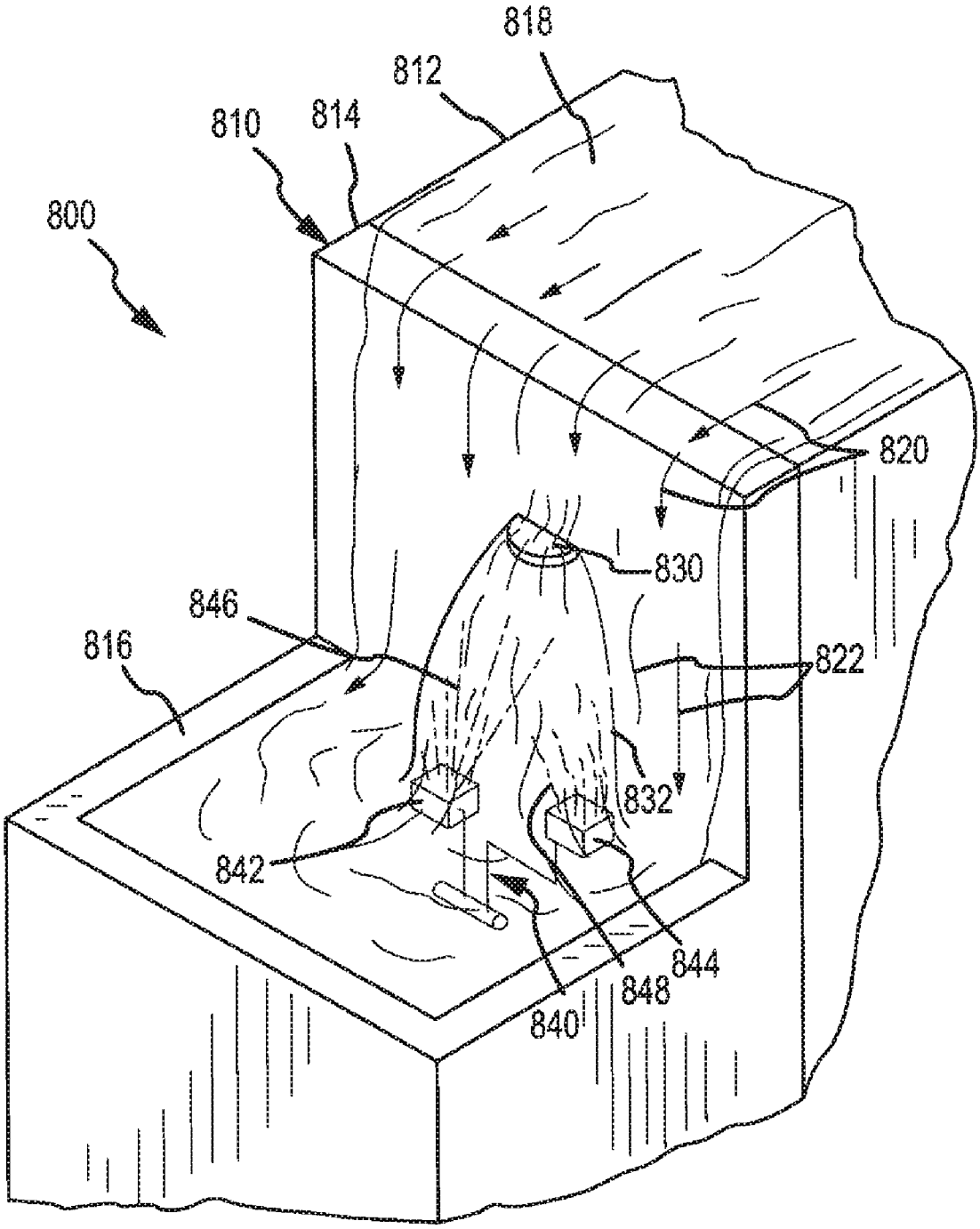
FIG. 8 illustrates another water attraction system that uses water under pressure such as flowing under forces of gravity over a wall to create a partial dome.

The above embodiments have generally relied on water or fluid being pumped upward through a nozzle to create the laminar domes. In other embodiments, water (or other fluid) is provided from above such as by gravity drain (or water under pressure or with fluid head flowing downward). In these cases, a deflector is provided that directs water flow into a full or partial dome shape to provide a void for capturing fog/gas as described above for the other domes. FIG. 8, for example, illustrates a water attraction system 800 in which a structure/flow channel 810 (e.g., a concrete or similar structure) is provided to direct water 818 stored in an upper or higher elevation (and, therefore, higher fluid head value) in tank/pool 812 over wall or weir 814 as shown at 820. The water 820 falls downward under pressure generally in a wall or sheet 822 near or adjacent the face of structural wall to be collected in the lower pool defined by wall 816 of structure 810. A deflector 830 is positioned near the face of wall 814 a distance (such as 4 to 24 inches or more above the surface water in the lower pool. The deflector 830 may be mounted on the wall 814 to extend out into the wall of water or waterfall 822 and is shaped and configured to direct the water to create walls/sides 832 of a water dome that extends outward from the wall 814 and/or water wall 822. As shown, the dome 832 is generally extends about 180 degrees in an arc from the wall 814 and is fully enclosed (as it abuts the wall 814 or water wall 822) so as to create an inner chamber/void in the form of a partial or half dome. A water dome effect assembly 840 (which may also be considered to include the deflector 830) is positioned in the pool defined by wall 816 and includes, in this example, a pair of light source/fog generator devices 842, 844 that can be operated to create light 846 and fog/mist 848 within the void or chamber created by the water dome 832 (as discussed in detail above).

Figure 9:
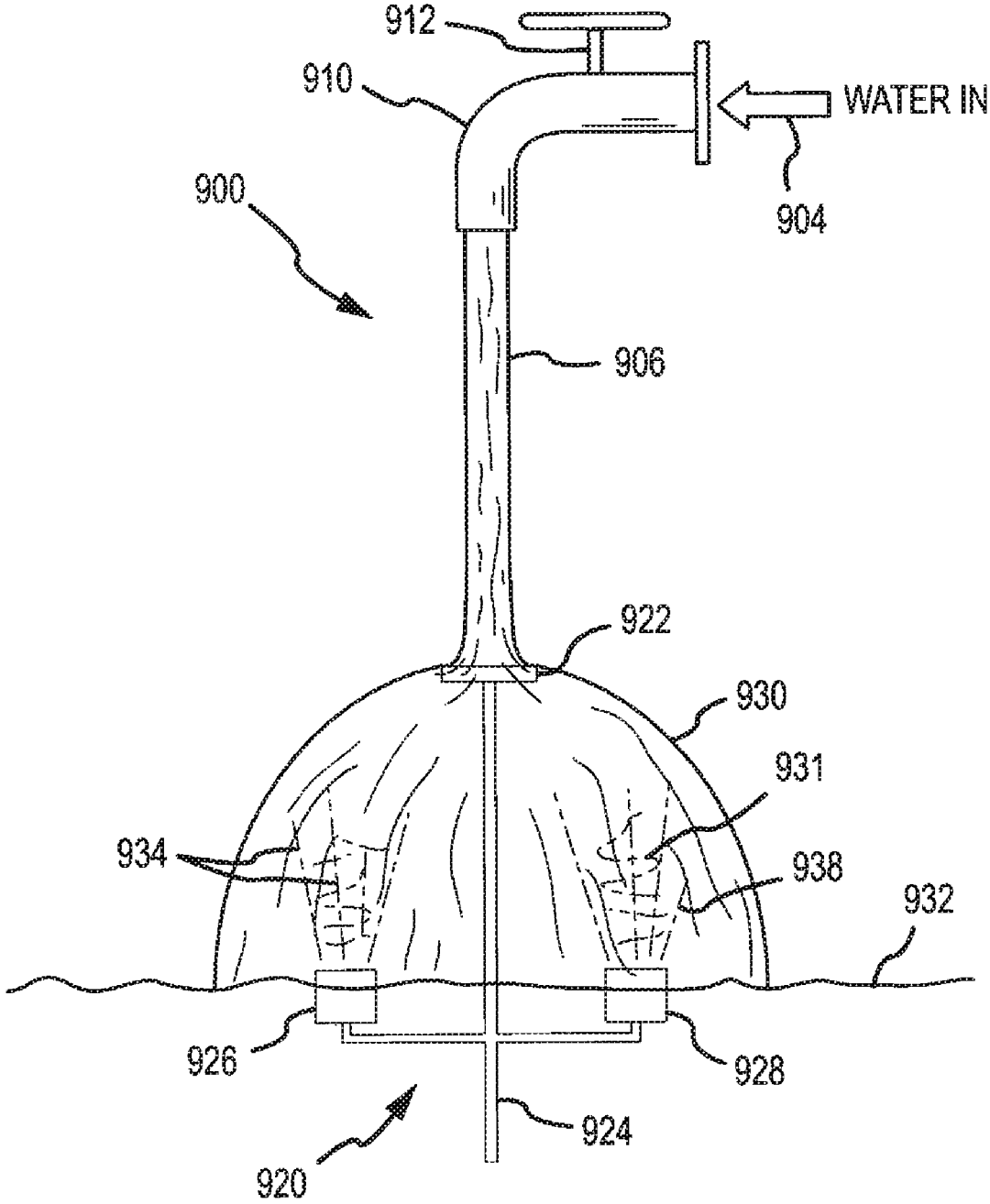
FIG. 9 shows another water attraction system that inputs water from above onto a deflector plate to create a water dome.

FIG. 9 illustrates an embodiment of a water attraction system 900 that also uses water 904 under pressure (e.g., from gravity, utility water, from a pump, or the like) to create a dome by providing water from above the dome. As shown, the inlet or source water 904 is provided in a controlled volume through a control or inlet assembly 910 with a throttle valve 912 that may simply be opened and closed or be adjustable to control flow to create a more desirable dome (e.g., based on the size/shape of the deflector and water pressure of water input 904. The discharged water 906 is directed toward (or downward) a water dome effect assembly 920 that is positioned within a pool 932 of water. A support structure or frame 924 supports a deflector plate 922 a distance above the surface of pool 932. The discharged water 906 falls on or strikes deflector 922 and is directed outward in all directions (e.g., 360 degrees about the deflector 922) to form a substantially continuous wall 930 to form a water dome with an inner chamber or void 931. The assembly 920 further includes a pair of fog/light generators 926, 928 that operate to selectively generated light 934 and mist/fog 938. The inlet assembly 910 may include a ret line that is connected to a pump(s) placed in the pool 932. As with other domes, the size of the dome may be adjusted to create a desired effect such as by operating the control valve 912 to adjust water flow 906, by choosing a particular shape/size of the deflector 922, and/or by selecting (and, in some cases, modifying during operation) the height of the deflector 922 above the surface of pool 932. Also, the distance between the outlet of inlet/nozzle assembly 910 and the deflector 922 may be varied to practice the invention such as less than 1 inch up to 1 foot or more.

I claim:

1. A fountain assembly, comprising:

a diverter provided to discharge an inlet volume of flowing liquid into a dome with an inner chamber defined by a wall extending about an outlet of the diverter; and a fog generation device generating a volume of fog, wherein the fog generation device is positioned in the fountain assembly to discharge the fog into the inner chamber of the dome formed by the diverter.

2. The assembly of claim 1, wherein the diverter is provided in a nozzle including the outlet, the nozzle further having an inlet receiving the inlet volume of liquid under pressure and positioned to direct the discharge upward through the outlet to form the wall defining the inner chamber of the dome.

3. The assembly of claim 1, wherein the fog generation device includes a float element to maintain at least a portion of the fog generation device at a preset depth below a surface of a pool of the liquid, the diverter is positioned a distance above the surface of the pool, and the inlet volume of flowing liquid is provided from a location above the diverter.

4. The assembly of claim 1, further comprising a light source positioned proximate to the nozzle to transmit light into the inner chamber to illuminate fog captured by the dome wall.

5. The assembly of claim 4, wherein the light source comprises two or more colored light sources, the light source being operable to selectively operate the colored light sources to color the illuminated fog.

6. The assembly of claim 1, wherein the fog generation device comprises a fogger with an ultrasonic transducer operable under a depth of liquid to generate fog.

7. The assembly of claim 1, wherein the wall is formed by the liquid flowing in a substantially laminar state, whereby the wall functions to constrain flow of the fog out of the dome.

8. The assembly of claim 1, wherein the wall is substantially continuous to substantially block flow of the fog through the wall.

9. A fountain system for creating a water attraction, comprising:

one or more pumps operable to provide water at a flow rate; and a plurality of fountain assemblies fluidically connected to the one or more pumps and positioned in a body of water, wherein each of the fountain assemblies comprises a nozzle receiving the water at the flow rate and discharging the water from a nozzle outlet to form a dome about the nozzle outlet and further comprises a fog generator positioned under a surface of the body of water and proximate to the nozzle, wherein the fog generator functions to generate fog that is discharged into the dome.

10. The fountain system of claim 9, wherein the dome comprises a substantially continuous wall of the discharged water in laminar flow.

11. The fountain system of claim 10, wherein the wall extends continuously about the periphery of the nozzle outlet and wherein the wall contains the generated fog within the dome.

12. The fountain system of claim 10, wherein the fog generator comprises an ultrasonic transducer.

13. The fountain system of claim 9, wherein each of the fountain assemblies further comprises a light source transmitting light into the dome to illuminate the fog discharged in the dome.

14. The fountain system of claim 13, wherein the light source comprises two or more selectively-operable, colored lights.

15. The fountain system of claim 9, further comprising means for controlling the flow rate to vary flow of the water provided to the nozzles over a range of flow rates, whereby a diameter of at least a portion of the domes may be altered.

16. The fountain system of claim 9, further comprising a gas supply system selectively discharging a gas into at least some of the domes and further comprising an ignition device selectively operable to ignite the discharged gas.

17. A method of providing a water attraction in a body of water, comprising:

providing a plurality of fountain assemblies in a pattern in the body of water, wherein each of the fountain assemblies comprises a bell fountain head discharging water as a wall of water defining a dome with an inner chamber;

pumping water to the fountain assemblies to form a plurality of the domes; and discharging fog into the inner chamber of the formed domes.

18. The method of claim 17, wherein the discharging of the fog comprises providing a fogger with each of the fountain assemblies and operating the foggers to generate fog from the body of water.

19. The method of claim 17, further comprising in at least some of the formed domes, illuminating the discharged fog in the inner chambers.

20. The method of claim 19, wherein the illuminating includes transmitting colored light upward into the inner chambers from below the surface of the body of water.

21. The method of claim 20, wherein the pattern is selected to create an image with the domes with the illuminated fog.

22. The method of claim 17, wherein the pumping of the water includes varying a flow rate of the water, whereby the plurality of the domes vary in size with the flow rate of the water.

23. The method of claim 17, wherein the walls of the formed domes comprises water flowing in a substantially laminar state, whereby the discharged fog is at least partially trapped within the domes.

24. The method of claim 17, wherein a set of the formed domes are positioned within the pattern to have overlapping ones of the walls such that the inner chambers of the set of the formed domes are in fluid communication.

* * * * *

UNITED STATES PATENT AND TRADEMARK OFFICE

CERTIFICATE OF CORRECTION

PATENT NO. : 7,775,457 B2
APPLICATION NO. : 12/098518
DATED : August 17, 2010
INVENTOR(S) : Schnuckle It is certified that error appears in the above-identified patent and that said Letters Patent is hereby corrected as shown below:

Column 11, line 44, delete "5114" and insert therefor --514--.

Signed and Sealed this

Twelfth Day of October, 2010

David J. Kappos

David J. Kappos
*Director of the United States Patent and Trademark Office*